United States Patent [19]

Rodi et al.

[11] Patent Number: 4,768,746

[45] Date of Patent: Sep. 6, 1988

[54] DEVICE FOR MATCHING A PRINTED PRODUCT

[75] Inventors: Anton Rodi, Leimen; Peter-Theodor Blaser, Dielheim; Jürgen Maass, Wiesloch, all of Fed. Rep. of Germany

[73] Assignee: Heidelberger Druckmaschinen AG, Heidelberg, Fed. Rep. of Germany

[21] Appl. No.: 24,685

[22] Filed: Mar. 11, 1987

[30] Foreign Application Priority Data

Mar. 11, 1986 [DE] Fed. Rep. of Germany ..... 3607984

[51] Int. Cl.[4] ..... A47B 97/04

[52] U.S. Cl. ..... 248/447; 248/292.1

[58] Field of Search ..... 248/441.1, 442.2, 447, 248/454, 292.1; 434/430, 429, 419; 108/28; 312/233, 7.2, 231, 234, 237

[56] References Cited

U.S. PATENT DOCUMENTS

| | | | |
|---|---|---|---|
| 624,641 | 5/1899 | Gallaher | 248/442.2 |
| 1,712,829 | 5/1929 | Klimowicz | 40/622 |
| 1,757,032 | 5/1930 | Wilson | 434/430 X |
| 3,156,056 | 11/1964 | Pribil | 434/430 X |
| 3,362,671 | 1/1968 | Johnson | 248/324 |
| 3,799,357 | 3/1974 | Govang | 434/430 |
| 3,981,086 | 9/1976 | Hoeflinger | 434/430 X |
| 4,005,539 | 2/1977 | Chamberlain | 40/622 |
| 4,011,671 | 3/1977 | Fogel | 434/430 |
| 4,140,296 | 2/1979 | Guillen | 248/447 |
| 4,591,122 | 5/1986 | Kreuzer | 248/280.1 |

FOREIGN PATENT DOCUMENTS

| | | | |
|---|---|---|---|
| 614112 | 11/1979 | Switzerland | 108/28 |

*Primary Examiner*—J. Franklin Foss

*Attorney, Agent, or Firm*—Herbert L. Lerner; Laurence A. Greenberg

[57] ABSTRACT

A device for matching a printed product having a matching table and a gallows firmly mounted on and extending above the matching table and carrying lighting device for illuminating the matching table from above includes a matching sheet holder secured to the gallows and disposed so as to be movable towards and away from a viewer located in front of the matching table, and a device for retaining the matching sheet holder independently in a respective selected position.

8 Claims, 1 Drawing Sheet

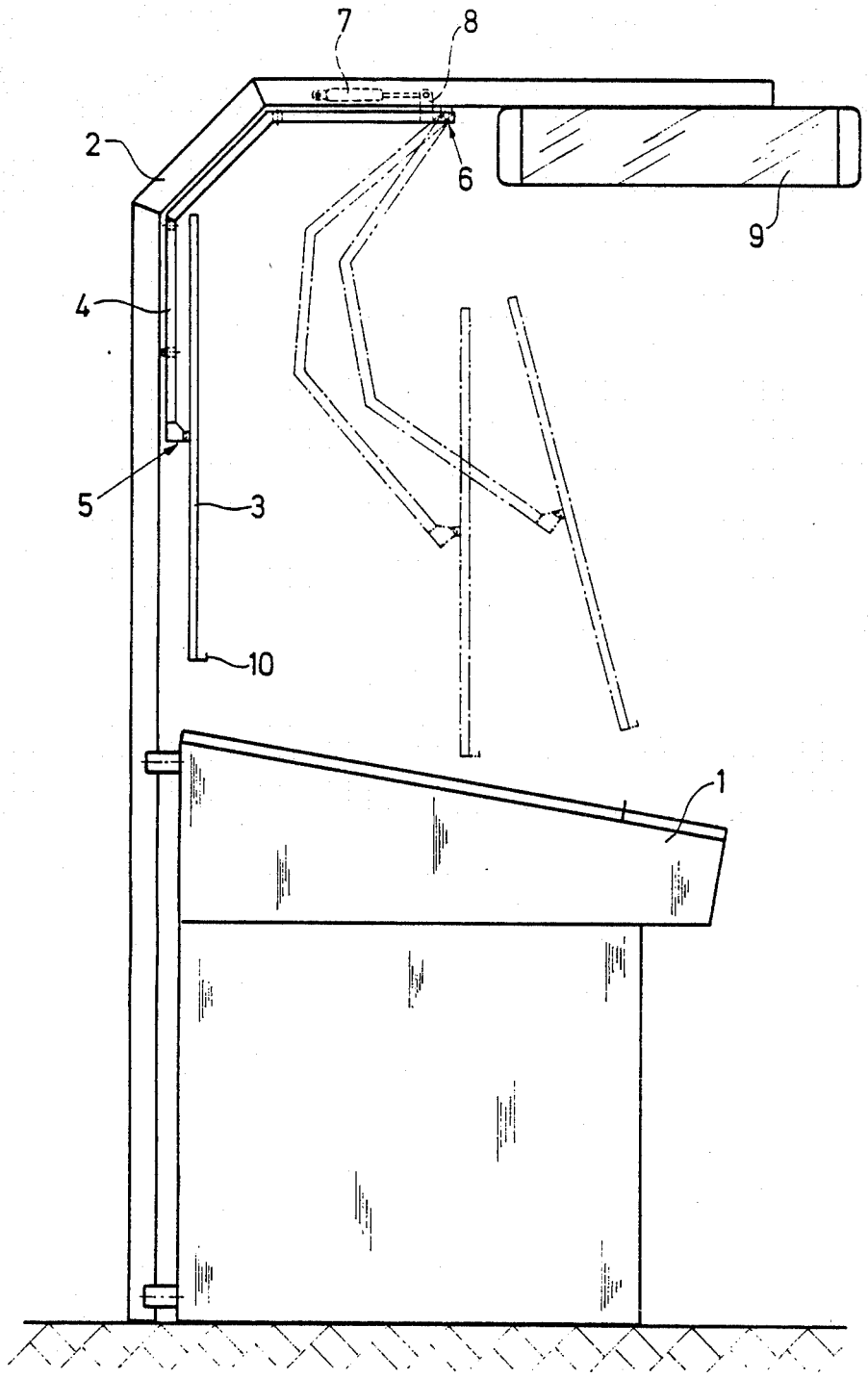
7
8
2
6
9
4
5
3
10
1

DEVICE FOR MATCHING A PRINTED PRODUCT

FIELD OF THE INVENTION

The invention relates to a device for matching a printed product having a matching table and a gallows firmly mounted on and extending above the matching table and carrying lighting means for illuminating the matching table from above.

During start-up of a printing machine as well as during the actual printing, it is necessary to check the quality of the printed product. During start-up, achieving the desired image quality as quickly as possible is sought after, i.e. in order to minimize paper waste and, during actual printing, constant checking of the printing conditions such as room temperature, nature of the paper, humidity in the air and ink consistency, for example, is required, because these conditions may change during the printing of a print run.

A specimen, a so-called matching sheet, serves as the standard for the required nominal or rated quality. The respective test sheet to be examined is compared with the matching sheet, a great degree of accuracy being ascribed to the performance of this comparison, because even tiny inaccuracies in the composition of the image, which are visible only under a magnifying glass, cause a change in the printing quality. In order to facilitate such a comparison, the arrangement of the matching sheet with respect to the test sheet should be favorable. For this purpose, the test sheet is placed on a matching table which is sloped or inclined towards the viewer, and the matching sheet is arranged on a side of the matching table located opposite to the viewer.

It has been known heretofore to attach the matching sheet to a gallows which simultaneously serves as a carrier to which a lighting system for the table is secured (CPC Console - HEIDELBERGER DRUCKMASCHINEN AG, see HEIDELBERG NEWS 3/37 1979).

Moreover, it has become known heretofore to apply the matching sheet to a stationary wall disposed perpendicularly to the matching table (advertising prospectus of the firm JUST, 7315 Weilheim, Federal Republic of Germany).

The foregoing methods of applying or attaching the matching sheet have the disadvantage, however, that the viewer must bend over the matching table when comparing the quality of the printed sheet to be examined with the matching sheet. Considering the size of such a matching table, this poses a considerable problem not only for small people but also those of average size.

DESCRIPTION OF THE RELATED ART

From the published Japanese Utility Model (IP 58-39866/39865), it has become known to shift the matching sheet holder horizontally adjacent the matching table. It is true that, with this method, it is no longer necessary for the viewer to bend over the table, because he or she may step close to the side of the table and thus be closer to the laterally displaced matching sheet. A disadvantage of this method, however, is that the viewer has to give up his viewing position and, consequently, inevitably loses sight of the sheet on the matching table. This fact has very negative effects, because better results are obtained when comparing two objects if those objects are located very close to one another.

SUMMARY OF THE INVENTION

It is accordingly an object of the invention to provide a device for matching a printed product which simplifies for the viewer a comparison of the actual condition of a printed product with the nominal or rated condition of the printed product and to improve its quality thereby.

With the foregoing and other objects in view, there is provided, in accordance with the invention, a device for matching a printed product having a matching table and a gallows firmly mounted on and extending above the matching table and carrying lighting means for illuminating the matching table from above, comprising a matching sheet holder secured to the gallows and disposed so as to be movable towards and away from a viewer located in front of the matching table, and means for retaining the matching sheet holder independently in a respective selected position.

An advantage of this invention is that the conventional mode of operation is reversed, that is to say, the matching sheet is arranged so as to be movable towards and away from the viewer, and the respective position is floatingly or self-supportingly maintained. Due to the fact that the viewer can remain in viewing position and may position the matching sheet according to his or her individual requirements, an accurate and exact comparison can be performed with a minimum change in viewing direction. The performance of the comparison is thereby accelerated and the quality improved.

In order to ensure a tilting and advance of the matching sheet holder in accordance with the requirements of the individual, connections between the matching sheet holder and the linkage system, as well as between the linkage system and the gallows are effected by respective joints in accordance with another feature of the invention.

In accordance with a further feature of the invention, a gas-pressure spring is provided for the purpose of achieving a slight attenuation of motion and an equalization of weight.

In accordance with an additional feature of the invention, relatively simple application or attachment of the matching sheet to the holder is ensured by forming the matching sheet holder of ferromagnetic material, thereby enabling the matching sheet to be applied or attached by means of permanent magnets.

In accordance with an alternate feature of the invention, the matching sheet holder is formed of relatively soft material such as wood which permits the matching sheet to be pinned thereto e.g. with thumbtacks. The same effect can be produced with an alternate feature of the invention, namely by providing soft padding which is applied to the matching sheet holder.

In accordance with yet another feature of the invention, the matching sheet holder is formed with perforations for the purpose of reducing the weight of the holder.

In accordance with a concomitant feature of the invention, the front edge of the matching sheet holder has a retaining strip or tray secured thereto which serves to hold different implements, such as a magnifying glass or pocket lens, for example.

Other features which are considered as characteristic for the invention are set forth in the appended claims.

Although the invention is illustrated and described herein as embodied in a device for matching a printed product, it is nevertheless not intended to be limited to the details shown, since various modifications and structural changes may be made therein without departing from the spirit of the invention and within the scope and range of equivalents of the claims.

BRIEF DESCRIPTION OF THE DRAWING

The construction and method of operation of the invention, however, together with additional objects and advantages thereof will be best understood from the following description of specific embodiments when read in connection with the single figure of the drawing which is a side elevational view of the device for matching a printed product in accordance with the invention.

DESCRIPTION OF THE PREFERRED EMBODIMENT

Referring now to the drawing, there is shown therein the device for matching a printed product according to the invention which has as basic elements, a matching table 1, a gallows 2, an overhead lighting system 9 and a matching sheet holder 3. The table 1 serves as an application surface for the respective test sheet or specimen to be examined. The matching sheet holder 3 extending out of and into the plane of the drawing serves to receive the matching sheet and is formed with a bottom channel strip or tray 10 for supporting the matching sheet at a bottom edge thereof as well as for holding tools such as a magnifying glass thereon. The viewer's position is located on the side of the matching table 1 opposite the gallows 2 i.e. at the right-hand side of the figure. From this position, it is possible for the viewer to observe and assess the test sheet as well as the matching sheet. The overhead lighting unit 9 ensures the illumination required for examination of the sheets.

By providing an articulating joint 6 fixed to the gallows 2 and about which a linkage system 4 pivots, it is possible to move the matching sheet holder 3 towards and away from the viewer in accordance with his or her individual requirements. A position of the matching sheet holder 3 selected by the viewer is maintained freely floating and suitable weight equalization required therefor is achieved by means of a gas pressure spring 7. One end of this gas pressure spring 7 is pivotally connected to the gallows and the other end i.e. the piston-rod end thereof, is pivotally connected to the linkage system 4 by means of a lever arm 8. An articulating joint 5 connects the linkage system 4 to the matching sheet holder 3 and permits tilting or tipping of the matching sheet holder 3 about a horizontal axis as well as automatic setting or adjustment of the matching sheet holder 3 into the selected tilted position. This automatic setting of the matching sheet holder 3 in the selected tilted position can be achieved by appropriate frictional forces within the joint 5 or by providing a suitable conventional locking device at the joint 5, depending upon the construction of the joint 5.

We claim:

1. Device for matching a printed product having a matching table with a more-or-less horizontal surface whereon a test sheet is disposable and a gallows firmly mounted on and extending above the matching table and carrying lighting means in a fixed position for illuminating the matching table and the test sheet from above, comprising a matching sheet holder secured to the gallows and having means for holding a printed sheet in a more-or-less vertical position, said sheet holder being disposed so as to be movable towards and away from a viewer located in front of the matching table, and means for retaining the matching sheet holder independently in a respective selected position, including a linkage system connected to said matching sheet holder by an articulating joint, including another articulating joint by which said linkage system is connected to the gallows.

2. Device according to claim 1, including means for tilting said matching sheet holder about a horizontal axis extending parallel to a front edge of the matching table.

3. Device according to claim 1, wherein said retaining means comprises a gas-pressure spring for effecting weight equalization to attain the respective selected position, said gas-pressure spring being connected at one end to the gallows and at the other end to said linkage system through the intermediary of a lever arm.

4. Device according to claim 1, wherein said matching sheet holder is formed with perforations.

5. Device according to claim 1, wherein said matching sheet holder has a soft padding.

6. Device according to claim 1, wherein said matching sheet holder is formed of a soft material.

7. Device according to claim 1, wherein said matching sheet holder is formed of ferromagnetic material.

8. Device according to claim 2, including a retaining strip secured to said front edge of said matching sheet holder.

* * * * *